US005425694A

United States Patent [19]

Negishi

[11] Patent Number: 5,425,694

[45] Date of Patent: Jun. 20, 1995

[54] PRINTER USING STACKER

[75] Inventor: Kiyoshi Negishi, Saitama, Japan

[73] Assignee: Asahi Kogaku Kogyo Kabushiki Kaisha, Tokyo, Japan

[21] Appl. No.: 332,051

[22] Filed: Nov. 1, 1994

Related U.S. Application Data

[63] Continuation of Ser. No. 26,409, Mar. 4, 1993, abandoned.

[30] Foreign Application Priority Data

Mar. 4, 1992 [JP] Japan ..... 4-083357

[51] Int. Cl.[6] ..... B65H 45/20

[52] U.S. Cl. ..... 493/320; 101/228; 493/413; 493/414

[58] Field of Search ..... 493/411, 413, 415, 23, 493/414, 412, 320; 101/228

[56] References Cited

U.S. PATENT DOCUMENTS

| | | | |
|---|---|---|---|
| 4,566,054 | 1/1986 | Shimoda et al. . | |
| 4,751,879 | 6/1988 | Van Pelt | 493/411 |
| 5,074,836 | 12/1991 | Fechner | 493/411 |
| 5,123,890 | 6/1992 | Green, Jr. | 493/411 |
| 5,149,075 | 9/1992 | Crowley | 493/411 |

*Primary Examiner*—Jack W. Lavinder

*Attorney, Agent, or Firm*—Sandler, Greenblum & Bernstein

[57] ABSTRACT

In a printer for printing images on a continuous form recording sheet, which can be used in association with a stacking device for folding and stacking the recording sheet discharged from the printer. A terminal is connected to the stacking device. A predetermined signal is applied to the terminal only while the recording sheet is being fed in the printer. The stacking device receives the predetermined signal and executes folding and stacking operations while it is receiving the predetermined signal.

11 Claims, 5 Drawing Sheets

PRINTER USING STACKER

This application is a continuation of application No. 08/026,409, filed Mar. 4, 1993, now abandoned.

BACKGROUND OF THE INVENTION

The present invention relates to a printer, which utilizes a continuous form recording sheet, and in association with which a stacker for folding and stacking the continuous form recording sheet is used. More specifically, the present invention relates to a printer which is capable of controlling the externally provided stacker to execute sheet folding and stacking operations.

There are printers capable of printing images and/or characters onto a continuous form recording sheet. Conventionally, in association with such printers, stackers for folding and stacking the continuous form recording sheet discharged from the printers are used.

FIG. 2 shows an example of the stacker which can be used in association with the printers described above. The stacker has a guide tray 2 for receiving a recording sheet 30 discharged from the printer, arms 43 driven by a motor located inside the stacker 40 (not shown in this drawing) to reciprocally rock about the shaft 42 in the direction of arrow X. There is provided a power switch 4 on the upper surface of the stacker 40.

In the construction above, a problem exists in that, if an operator should turn ON/OFF the stacker independent of the operation of the printer, the stacker 40 may remain turned ON even if the recording sheet is not being discharged from the printer. In other words, the stacker may be turned ON even if it is unnecessary, which causes waste of the electricity. Further, if the stacker keeps operating, i.e., a sheet folding and stacking operation even if the sheet is not being fed, the arms 43 of the stacker may make noise as they touch the recording sheet which is stopped.

SUMMARY OF THE INVENTION

It is therefore an object of the invention to provide an improved printer capable of driving a stacker in accordance with the sheet feed operation. For the objects, according to the present invention, there is provided a printer for printing images on a continuous form recording sheet, wherein the printer includes:

means for feeding the recording sheet;

means for driving the feeding means to feed the recording sheet by transmitting a first predetermined signal to the feeding means;

a terminal to which an external device is to be electrically connected; and means for applying the second predetermined signal to the terminal only while the first predetermined signal is being transmitted, whereby the second predetermined signal is applied to the terminal only while the feeding means is feeding the recording sheet.

Optionally, the second predetermined signal comprises the first predetermined signal.

Alternatively, the second predetermined signal comprises electric power which is sufficient to actuate said external device.

The external device can be a stacking device capable of folding and stacking the recording sheet discharged from the printer.

According to another aspect of the invention, there is provided a printer for printing images on a continuous form recording sheet, the printer being externally provided with a stacking device which is actuated to fold and stack the continuous form recording sheet discharged from the printer, wherein the printer includes:

means for feeding the recording sheet;

means for driving the feeding means to feed the recording sheet by outputting a predetermined signal to the feeding means;

means for outputting the predetermined signal to the stacking device only while the driving means is driving the feeding means to feed the recording sheet.

Optionally, the outputting means comprises a terminal through which the stacking device is electrically connected to the driving means.

According to further aspect of the invention, there is provided a combination of a printer for printing images on a continuous form recording sheet, and a stacker to be used in association with the printer, the stacker being actuated to fold the recording sheet discharged from the printer, and wherein the printer includes:

means for feeding the recording sheet;

means for driving the feeding means to feed the recording sheet by outputting a first predetermined signal to the feeding means;

a terminal to which an external device is electrically connected; and means for applying the second predetermined signal to the terminal only when the first predetermined signal is outputted, and wherein the stacker includes:

means for receiving the second predetermined signal; and means for folding and stacking the recording sheet only while the receiving means is receiving the predetermined signal.

DESCRIPTION OF THE ACCOMPANYING DRAWINGS

DESCRIPTION OF THE EMBODIMENTS

Figure 1:
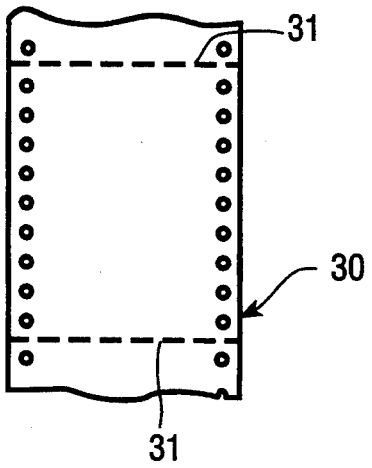
FIG. 1 shows a fan-fold sheet used in a printer.

FIG. 1 shows a so-called fan-fold sheet 30 generally used as a continuous form recording sheet for a printer. In the fan-fold sheet 30, there are provided a perforated lines 31, 31 . . . . across its width at a predetermined interval.

Figure 6:
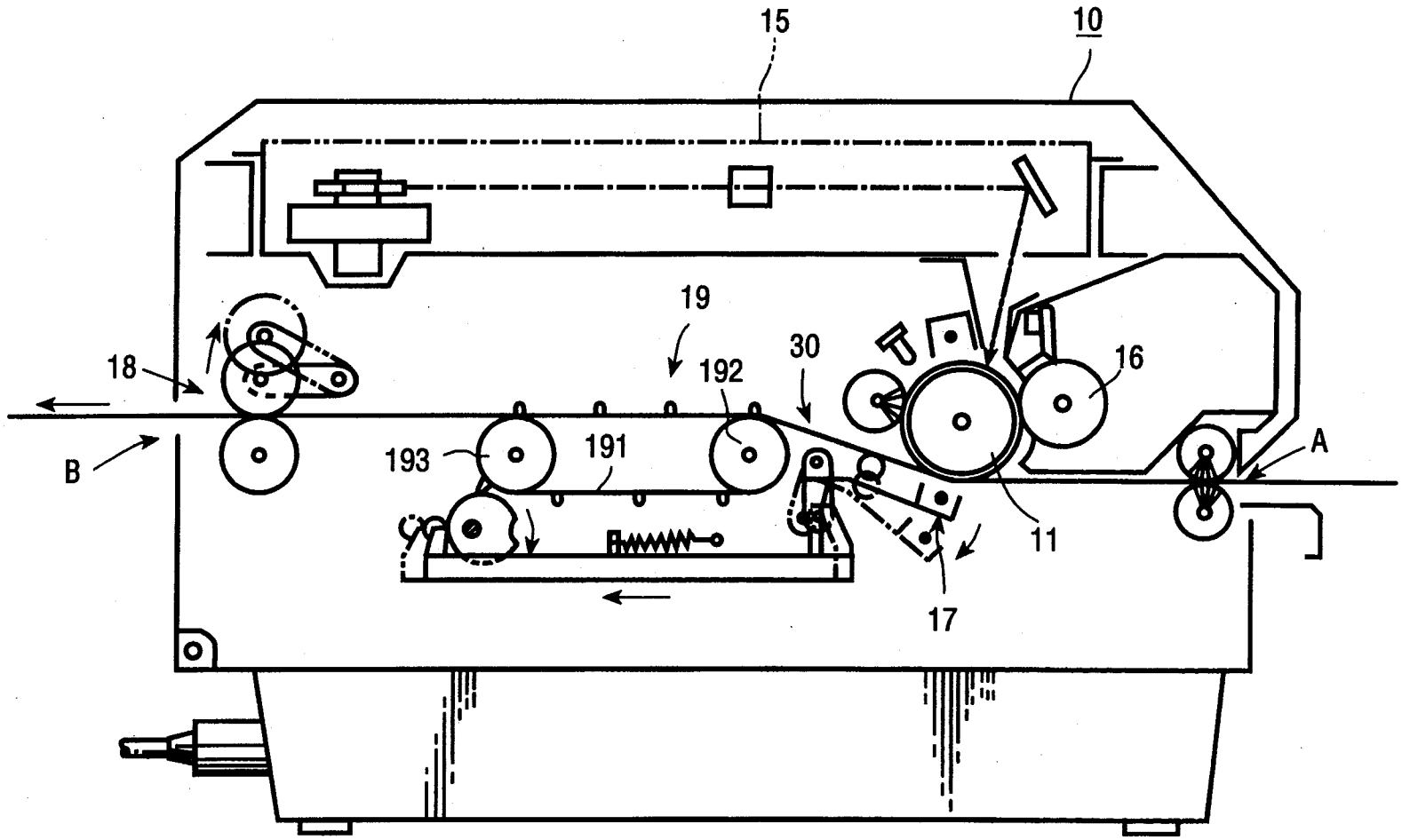
FIG. 6 is a schematic side view of the printer.

FIG. 6 is a schematic side view of an electrophotographic printer 10 embodying the present invention. In the printer 10, along a feed path of the fan-fold sheet 30 between an inlet A and an outlet B, there are provided a photoconductive drum 11, a developing unit 16, a transferring unit 17, and a fixing unit 18. Between the transferring unit 17 and the fixing unit 18, there is a tractor unit 19 provided with a pair of belts 191 and 191 which proceed as the fan- fold sheet 30 is fed, and two pairs of pulleys 192 and 193 around which the belts 191 and 191 are wound.

Figure 7:
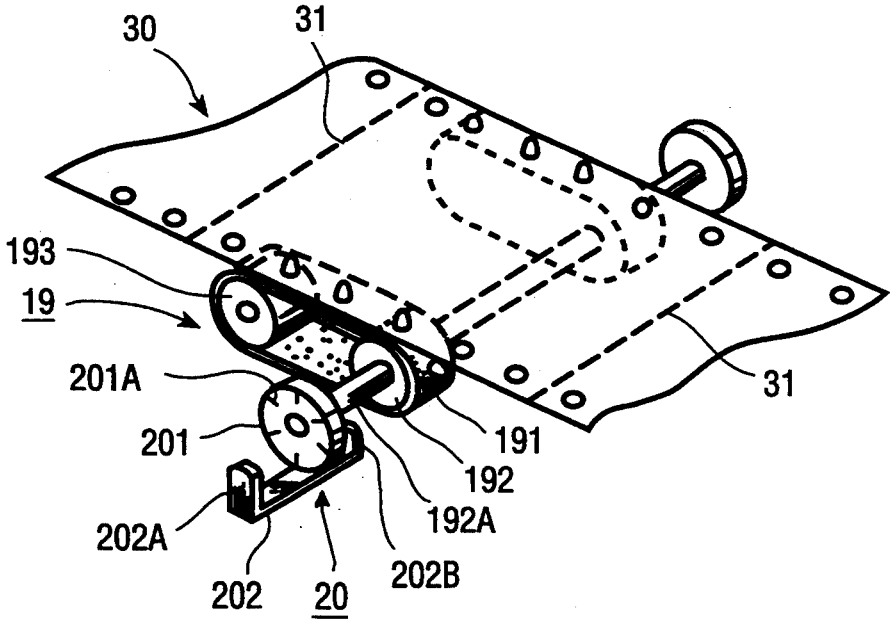
FIG. 7 is a perspective view showing an encoder mechanism.

As shown in FIG. 7, an encoder 20 is provided in the printer 10. The encoder 20 includes a disk member 201 secured on a shaft 192A of the pulley 192. On the disk member 201, a plurality of slits 201A are radially formed at a predetermined interval. Further, a photo sensor 202 having a light emitting element 202A and a light receiving element 202B is provided with the disk member 201 located therebetween. Thus, as the fan-fold sheet 30 is fed, the tractor belts 191 and 191 proceed, thereby rotating the disk member 201. Since the slits 201A allow the light emitted by the light emitting element 202A to pass through, as the fan-fold sheet is fed, a pulse signal is generated by the encoder 20. This pulse signal is transmitted to an engine driver E which will be described later.

Figure 3:
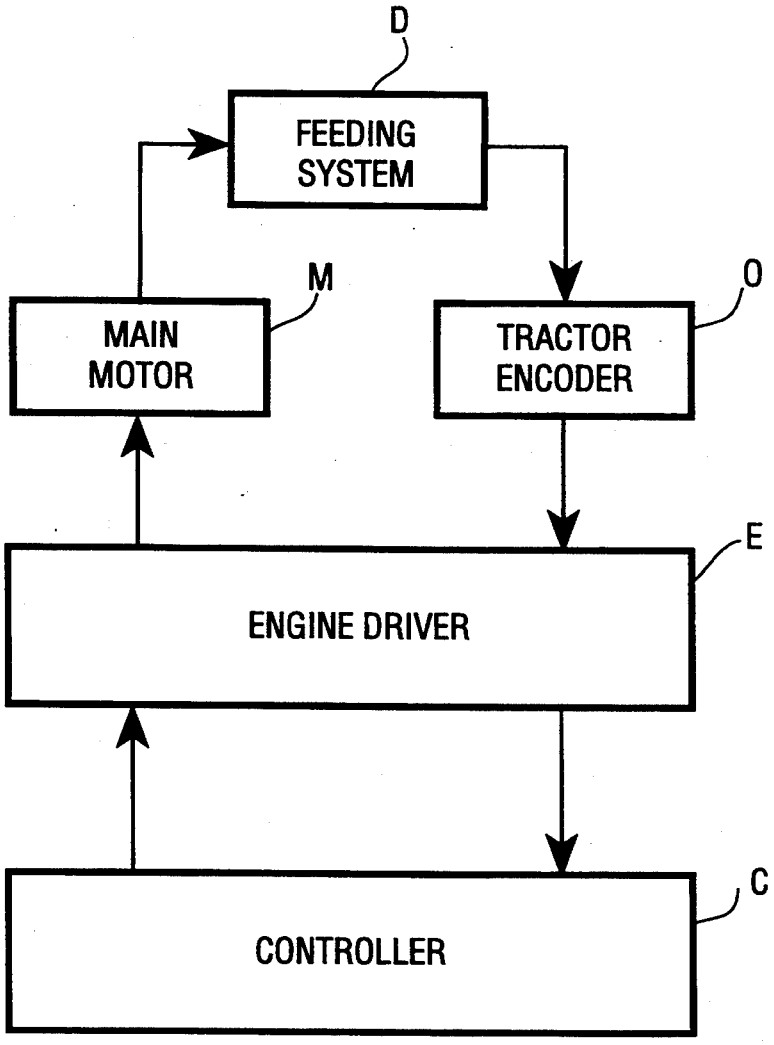
FIG. 3 is a block diagram showing a control system of the printer embodying the present invention.

FIG. 3 is a block diagram illustrating the construction of the control system of the printer 10. The control system includes a sheet feeding system D, a main motor M for driving the sheet feeding system D, an engine driver E for controlling the main motor M and other drive sources for driving the sheet feeding system 10, and a controller C for controlling the engine driver E, an optical system and other systems which are not shown in the figure.

In the engine driver E, a sheet feed condition signal is generated based upon whether the pulse signal if inputted form the photo sensor 202 or not. The sheet feed condition signal is, for example, a signal having "H" (high) and "L" (low) states corresponding to the feeding condition of the recording sheet 30. The sheet feed condition signal is transmitted to a signal output terminal S and to the controller C. The controller C determines when the image information (circuit pattern) is to be required depending upon the status of the sheet feed condition signal.

Figure 2:
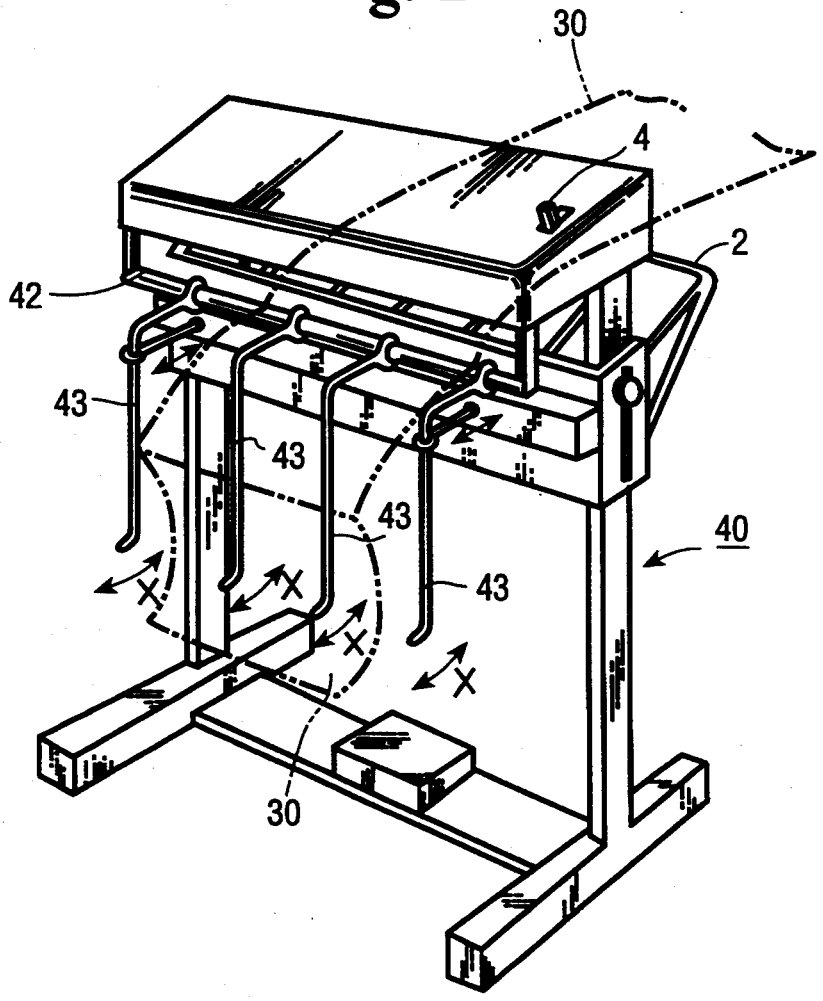
FIG. 2 shows an example of a stacker which is used in association with a printer embodying the present invention.
Figure 4:
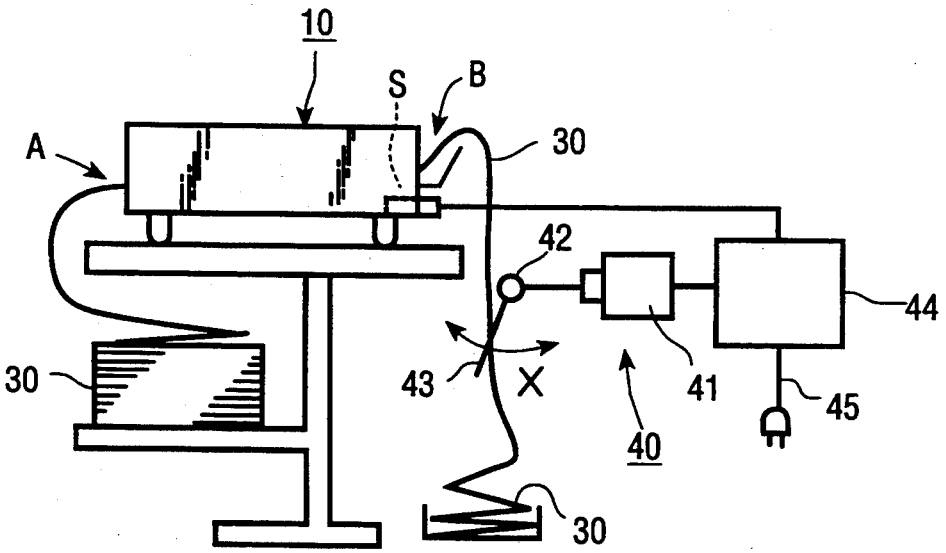
FIG. 4 is a block diagram showing an embodiment of a printer, and a stacker used in association therewith.

FIG. 4 shows a schematic diagram showing the printer 10, and the stacker 40 used in association with the printer 10. According to the present invention, the conventional stacker as shown in FIG. 2 can be used in association with the printer 10.

The arms 43 are driven to rock in the direction of arrow X in FIG. 4 to fold the recording sheet 30 at the perforated lines. The arms 43 are controlled to rock by a motor 41, turning ON/OFF of the motor 41 being controlled by a control unit 44.

As shown in FIG. 4, the control unit 44 is connected with the printer 10 at the terminal S. The control unit 44 turns ON or OFF the motor 40 in accordance with the sheet feed condition signal transmitted through the terminal S. More specifically, when the recording sheet 30 is being fed, the motor 41 is actuated, while the motor 41 is turned OFF when the recording sheet 30 is not fed even if the printer 10 is turned ON. Thus, the movement of the arms 43 can be controlled without operating the power switch 4 of the stacker 40.

Since the arms 43 are controlled in accordance with the feeding condition of the recording sheet, the waste of electricity can be avoided, and the noise which would be made by the guide arms 43 and the recording sheet can also be avoided.

Figure 5:
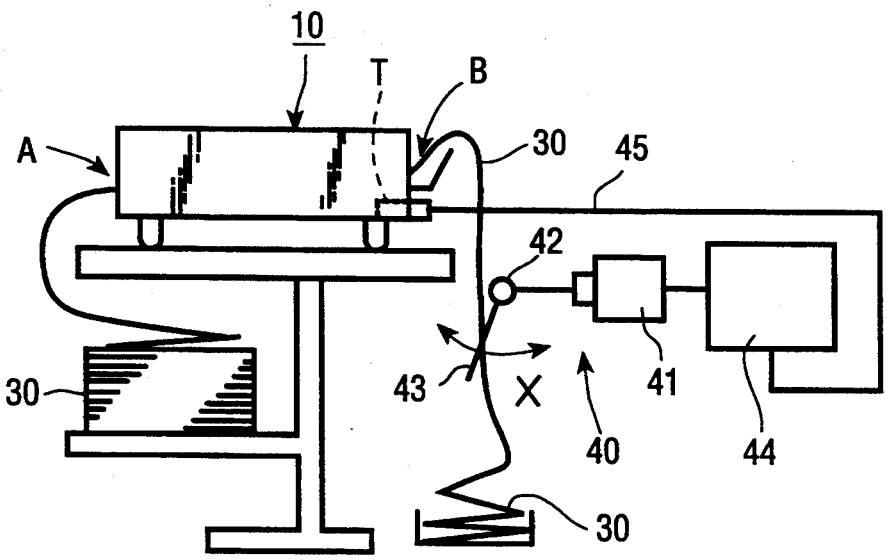
FIG. 5 is a block diagram showing a modified embodiment of a printer, and a stacker used in association therewith.

FIG. 5 shows a modified embodiment of the present invention. In the modified embodiment, an electrical socket T is provided instead of the terminal S of the embodiment in FIG. 4. In the modified embodiment, the control unit C supplies the electricity (electrical power), which is sufficient to actuate the stacker 40 to fold and stack the recording sheet 30, to the socket T only when the recording sheet is being fed, while the electricity is not supplied when the recording sheet is not fed. With this construction, any type of stacker having an electrical plug can be controlled in accordance with the feeding condition of the recording sheet.

In the foregoing descriptions, the tractor encoder 20 detects the feeding condition of the fan-fold sheet 30; the engine driver E generates the sheet feed condition signal; and the ON/OFF condition of the stacker is controlled in accordance with the sheet feed condition signal. Alternatively, the stacker can be controlled in accordance with a clutch control signal for connecting-/disconnecting a clutch mechanism provided in the sheet feed system D. The clutch control signal is transmitted to the sheet feed system D from the engine driver E to control the movement of the recording sheet 30.

Still alternatively, it would be possible to use the controller C as a sheet feed control system, and to control the movement of the stacker 40 in accordance with a control signal outputted by the controller C.

As described above, according to the present invention, the operation of the stacker, which is provided separately from the printer, is controlled based upon whether the recording sheet is fed or not in the printer. Thus, the stacker is automatically turned ON/OFF without the operation of the power switch of the stacker. Accordingly, the waste of electricity can be effectively avoided, and the noise caused by the friction of the arm of the stacker and the recording sheet can be eliminated. Further, according to the second embodiment of the present invention, the electricity applied to the electrical socket provided in the printer is controlled based upon the sheet feed condition in the printer. Thus, any type of the stacker, even if it is not specifically designed for the used printer, can be ON/-OFF controlled in accordance with the sheet feed condition in the printer.

The present disclosure relates to subject matter contained in Japanese Patent Application No. HEI 48-3357, filed on Mar. 4, 1992, which is expressly incorporated herein by reference in its entirety.

What is claimed is:

1. A detachable stacker for use with a printer for printing images on a continuous recording sheet which is fed through said printer, said detachable stacker comprising:

means for detachably connecting said stacker to said printer;

means for folding and stacking said continuous sheet;

a motor for driving said means for folding and stacking;

means for determining whether said recording sheet is being fed by said printer, said means for determining turning on said motor only while said recording sheet is being fed by said printer.

2. The detachable stacker according to claim 1, said means for determining including a control unit, said control unit receiving a signal from said printer when said recording sheet is being fed, said control unit turning on said motor in response to receipt of said signal.

3. The detachable stacker according to claim 1, wherein said means for detachably connecting supplies electric power to said stacker for driving said motor, said electric power being supplied to said motor only while said means for determining determines that said recording sheet is being fed by said printer.

4. The detachable stacker according to claim 3, wherein said electric power is sufficient to operate said motor.

5. A combination of a printer for printing images on a continuous form recording sheet, and a detachable stacker to be used in association with said printer, said stacker being actuated to fold said recording sheet discharged from said printer, said printer comprising:

means for feeding said recording sheet;

means for driving said feeding means to feed said recording sheet; and a terminal to which said stacker is electrically connected;

said stacker comprising:

means for detachably connecting said stacker to said terminal;

means for folding and stacking said recording sheet;

a motor for driving said means for folding and stacking;

means for determining whether said recording sheet is being fed by said printer, said means for determining turning on said motor only while said recording sheet is being fed by said printer.

6. The combination according to claim 5, said means for determining including a control unit, said control unit being connected to said terminal and receiving a signal from said printer when said recording sheet is being fed, said control unit turning on said motor in response to receipt of said signal.

7. The combination according to claim 6, said means for feeding including a detector for detecting when a recording sheet is being fed, said detector emitting said signal.

8. The combination according to claim 7, wherein said signal is a pulse signal, said detector including an encoder connected to said means for driving said feeding means, for generating said pulse signal when said feeding means is driven.

9. The combination according to claim 8, wherein said encoder includes a disk having slits and a photo sensor.

10. The combination according to claim 5, wherein said means for detachably connecting supplies electric power to said stacker for driving said motor, said electric power being supplied to said motor only while said means for determining determines that said recording sheet is being fed by said printer.

11. The combination according to claim 10, wherein said electric power is sufficient to operate said motor.

* * * * *